US010723551B2

(12) United States Patent
Rowland et al.

(10) Patent No.: US 10,723,551 B2
(45) Date of Patent: Jul. 28, 2020

(54) ADAPTER TO UNLOAD REAR LOADING CONTAINER INTO SIDE LOADING COMPACTION BODY

(71) Applicant: Kann Manufacturing Corporation, Guttenberg, IA (US)

(72) Inventors: Jared L. Rowland, Dyersville, IA (US); Kenneth D. Goedken, Dubuque, IA (US); Roger Taake, Elkader, IA (US); Marlin L. Johnson, Guttenberg, IA (US)

(73) Assignee: KANN MANUFACTURING CORPORATION, Guttenberg, IA (US)

( * ) Notice: Subject to any disclaimer, the term of this patent is extended or adjusted under 35 U.S.C. 154(b) by 117 days.

(21) Appl. No.: 15/191,851

(22) Filed: Jun. 24, 2016

(65) Prior Publication Data

US 2016/0304277 A1 Oct. 20, 2016

Related U.S. Application Data

(60) Division of application No. 13/891,831, filed on May 10, 2013, now Pat. No. 9,399,551, which is a continuation of application No. 13/011,293, filed on Jan. 21, 2011, now Pat. No. 8,534,977.

(60) Provisional application No. 61/299,579, filed on Jan. 29, 2010.

(51) Int. Cl.
*B65F 3/04* (2006.01)
*B65F 3/02* (2006.01)

(52) U.S. Cl.
CPC ..... *B65F 3/041* (2013.01); *B65F 3/02* (2013.01)

(58) Field of Classification Search
CPC .... B65F 3/08; B65F 3/024; B65F 2003/0243; B65F 2003/025
See application file for complete search history.

(56) References Cited

U.S. PATENT DOCUMENTS

| | | | |
|---|---|---|---|
| 2,824,657 | A | 2/1958 | Beasley et al. |
| 2,824,658 | A | 2/1958 | Beasley |
| 2,828,032 | A | 3/1958 | Beasley et al. |
| 2,949,199 | A | 8/1960 | Jones |
| 3,217,913 | A | 11/1965 | Aldredge et al. |
| 4,090,626 | A | 5/1978 | Ebeling et al. |
| 4,867,630 | A | 9/1989 | Johnson et al. |
| 5,316,430 | A | 5/1994 | Horning et al. |

(Continued)

OTHER PUBLICATIONS

Kann Manufacturing Corporation, KDGHETTS, "Kann Route King Series—Kann Adaptor (KA).wmv", Dec. 14, 2010, YouTube—Screen print of website video: http://www.youtube.com/watch?v=gcTCcBBK8Do.

(Continued)

*Primary Examiner* — Jonathan Snelting
(74) *Attorney, Agent, or Firm* — Shuttleworth & Ingersoll, PLC; Brett D. Papendick

(57) ABSTRACT

An adapter to allow a sideloading refuse collection body to empty a rear loading container having trunnions. The adapter has a pair of spaced apart trunnion pockets to receive opposing trunnions of the container. A pair of lock arms on the adapter can be lowered against the tops of opposing sides of the container to lock the container in the trunnion pockets and against a stabilizer which engages the front wall of the container. The adapter includes a guide plate aligned with and extending from the front wall of the container. Lift arms on the collection body are joined to opposing sides of the adapter.

7 Claims, 6 Drawing Sheets

(56) References Cited

U.S. PATENT DOCUMENTS

| | | | |
|---|---|---|---|
| 6,027,299 | A | 2/2000 | Williams |
| 6,089,813 | A | 7/2000 | McNeilus et al. |
| 6,224,317 | B1 | 5/2001 | Kann et al. |
| 6,474,928 | B1 | 11/2002 | Christenson |
| 6,722,839 | B2 | 4/2004 | Bingman |
| 6,821,077 | B2 | 11/2004 | Neufeldt |

OTHER PUBLICATIONS

Kann Manufacturing Corporation, KDGHETTS, "Kann Side Loader with Rear Loader Container Adapter.wmv", Mar. 15, 2010, YouTube—Screen print of website video: http://www.youtube.com/watch?v=7QuGnG2HtU0.

Kann Manufacturing Corporation, KDGHETTS, "Kann Curb Master Series—Dual Side Loader—Model SL.wmv", Dec. 21, 2010, YouTube—Screen print of website video: https://www.youtube.com/watch?v=tH1iiVpS9Bss.

ADAPTER TO UNLOAD REAR LOADING CONTAINER INTO SIDE LOADING COMPACTION BODY

CROSS REFERENCE TO RELATED APPLICATIONS

This application is a divisional of U.S. patent application Ser. No. 13/891,831 filed May 10, 2013, which is a continuation of, and claims priority, from non-provisional application Ser. No. 13/011,293 titled ADAPTER TO UNLOAD REAR LOADING CONTAINER INTO SIDELOADING COMPACTION BODY which was filed Jan. 21, 2011, which claimed priority under 35 USC § 119 from then provisional patent application entitled ADAPTER TO UNLOAD REAR LOADING CONTAINER INTO SIDE LOADING COMPACTION BODY, Ser. No. 61/299,579, filed Jan. 29, 2010. The disclosures of nonprovisional patent application Ser. No. 13/891,831, non-provisional application Ser. No. 13/011,293, and provisional patent application Ser. No. 61/299,579 are hereby incorporated in their entireties.

BACKGROUND

Refuse, recycling and green waste commodity may be placed in any one of a variety of different waste containers. Conventionally, these containers range in volume between two cubic yards and ten cubic yards and can normally be categorized as either being designed for collection by a front end loader (FEL), side loader (SL) or rear end loader (REL) style truck. Since the application and methods of collection are considerably different among these styled units, the containers for each of these trucks are normally mutually exclusive.

FEL waste containers generally include channels or fork pockets built into the sides of the waste container. The collection of commodity from FEL waste containers has typically required a specialized commodity collection vehicle having a pair of spaced forks supported by a pair of lifting arms. To engage and unload the FEL container, the fork must be inserted into the channels and the lift arm must be actuated to lift and invert the FEL container over an opening communicating with an interior storage compartment of the vehicle.

The collection of commodity from SL containers requires a specialized collection vehicle having a pocketed assembly mounted to a lift carriage. To engage and lift the SL container, the pocketed assembly is positioned into a specialized hooked plate configuration attached to the SL container and the lift carriage is actuated to lift the SL container over an opening communicating with an interior storage compartment of the vehicle.

To load commodity from REL containers requires a specialized collection vehicle having a lower back-end configured to engage each end of a trunnion on the container and a cable at the rear of the vehicle configured to be connected to a top rear portion of the REL container. A motorized winch on the vehicle is then used to pull and lift the REL container off of the ground while the body of the REL container pivots about the trunnion and empties its contents into the rear of the vehicle. In lieu of the winch and cable, some commodity collection vehicles utilize a hydraulic lifting apparatus configured to move the container about the trunnion into a dumping position.

Since the applications and the methods of collection between FEL, RL and REL trucks are so different, the designs of waste containers to be collected by the different style trucks are normally mutually exclusive. As a result, waste hauling companies are forced to maintain a larger inventory of varying types of collection vehicles and an equally large inventory of varying types of containers making it expensive and inconvenient. Further, the modification of containers to fit the collection mechanisms of other specialized collection vehicles is also expensive and inconvenient. Therefore, there is a continuing economic need to find ways to make these specialized commodity collection vehicles more route flexible by enabling them to be more capable to unload commodity from the normally mutually exclusive containers, wherever possible.

SUMMARY OF THE INVENTION

This present invention provides a solution to the problems of being unable to unload a rear end loading container into a side loader collection body by providing an adapter to allow a side loader collection body to empty a rear end loading container. Rear end loading containers have a trunnion extending from each opposing end of the container. These trunnions are located adjacent the front wall of the rear end loading container near the top of the container. A rear end loader collection body is equipped with a low trough at the rear end of the body into which commodity is dumped. Trunnion receiving pockets are mounted on the loading trough. After the trunnions of the rear end loading container are received in pockets on the trough, a chain or cable is attached to the rear wall of the container and the container can then be rotated to tip it into an inverted position so that the contents of the rear end loading container will fall into the trough of the rear end loading refuse body.

Side loader (SL) collection bodies require that the commodity enter at the top of a compaction chamber forward of a storage compartment of the body where the refuse commodity is compacted and forced from the compaction chamber into the storage compartment. Existing SL collection bodies typically include a trough mounted on lift arms alongside the compaction chamber into which bagged or loose commodity may be placed before the trough is elevated into an inverted dumping position above the load opening of the compaction chamber. A cart latch may be attached to the trough so that residential waste containers can be latched to the trough and carried upward with the trough into an inverted position over the load opening of the compaction chamber. In other SL collection bodies, an extendible arm reaches from the body and grasps a side loading refuse container by either clamping the sides of the container or by coupling with a receiver element of the container. The arm can then raise the side loading container and tip it over the load opening of the SL collection body.

The present invention provides an adapter which can be mounted to the SL refuse body to permit the SL collection body to attach to a rear end loading container and to elevate the container to an inverted position over the load opening of the SL collection body.

The adapter may be attached to the lifting mechanism in place of the standard trough to adapt the SL collection body to be able to empty rear end load style containers. The adapter is equipped with a pair of trunnion pockets which are spaced apart and aligned with the trunnions which extend from opposing ends of the rear end load container. A pair of lock arms are spaced apart and align with opposing sides of the container and, in the locking position, are positioned against the top of the opposing end walls of the rear end load container to prevent the container from rotating too far or falling into the compaction body when the container is in the inverted unloading position. Lift arms of the SL collection body attach to the adapter by connection with the trunnion pockets on opposing sides of the adapter to secure the adapter to the lifting mechanism. The adapter includes track rollers at each end which are carried on the trunnion pockets and are spaced apart to align with opposing tracks on the refuse body which guide the adapter as it is moved from the lowered connection position to the inverted elevated position.

The primary object of the invention is to provide an adapter for a side loading commodity collection body which allows the loading apparatus of the side loading collection body to empty a waste container designed for a rear loading commodity collection body.

DETAILED DESCRIPTION

Figures 1, 2:
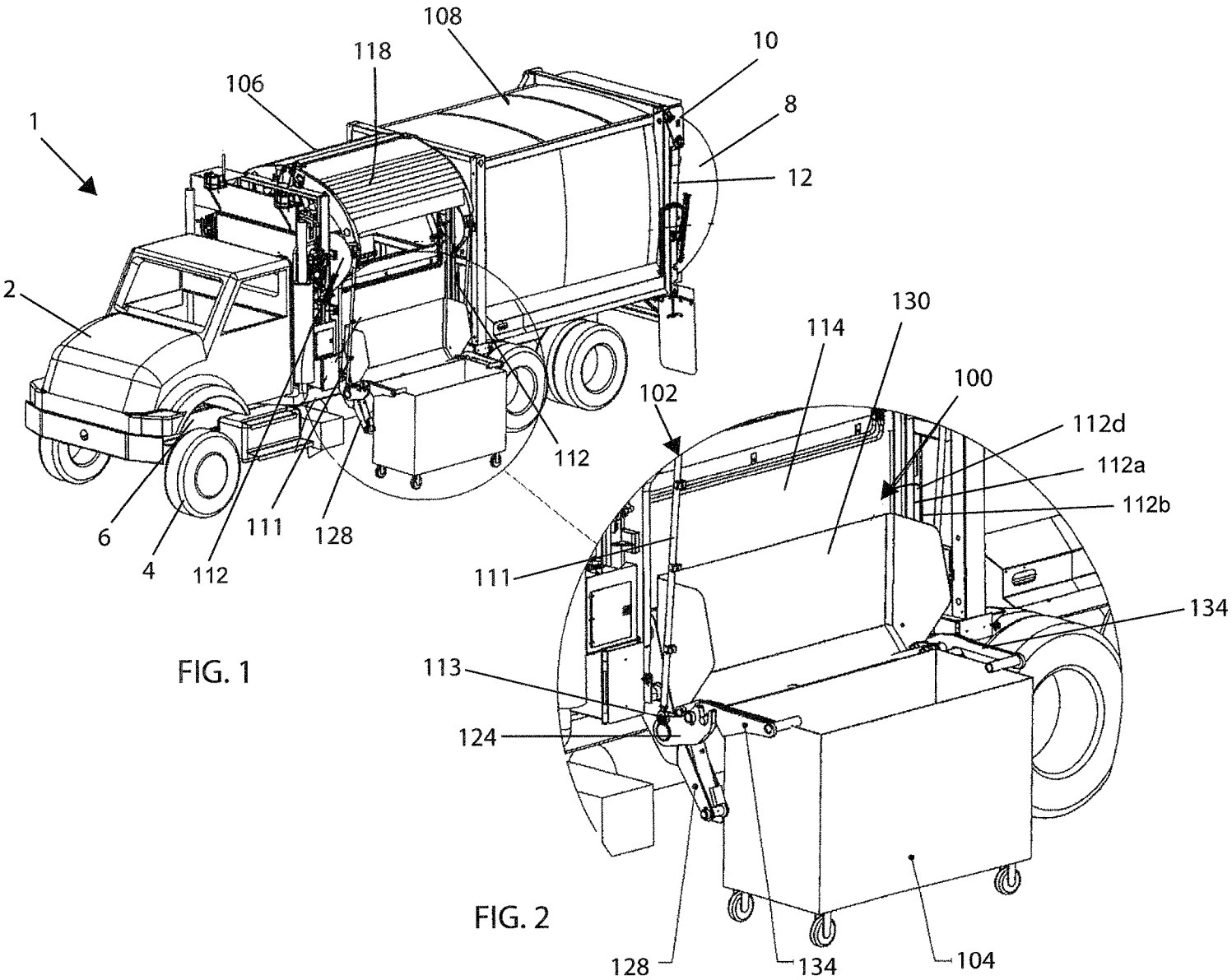
FIG. 1 is a perspective view of the adapter of the present invention mounted on a side load refuse hauling vehicle showing the adapter clamped on a rear end loading container.
FIG. 2 is an enlarged perspective of the adapter of FIG. 1.
Figure 3:
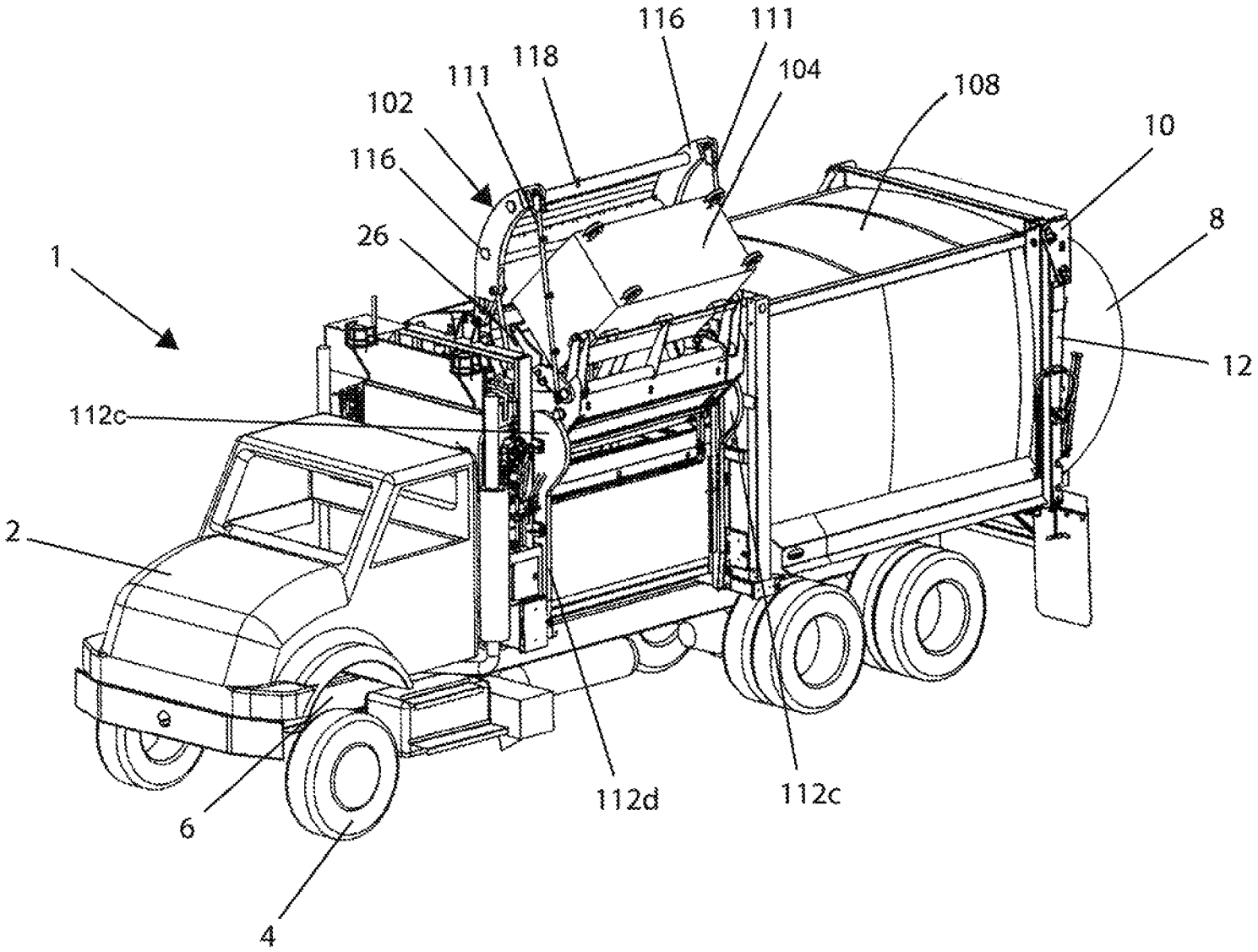
FIG. 3 is a perspective view of the adapter combined with the side load refuse hauling vehicle with the container shown in the inverted unloading position.
Figure 5:
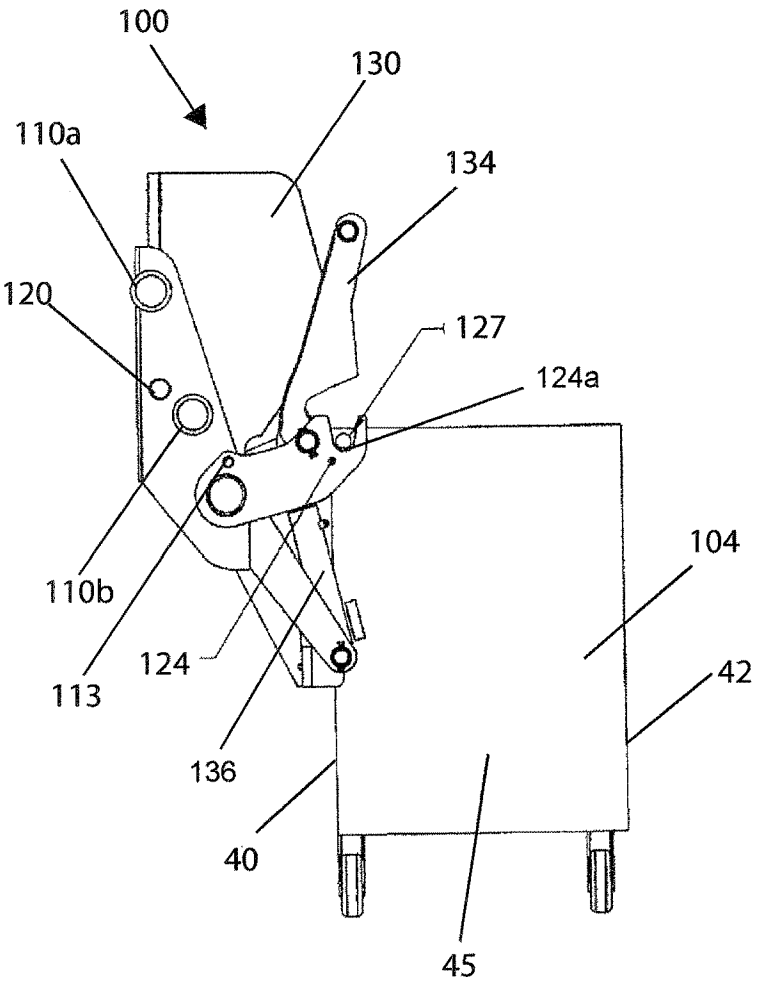
FIG. 5 is a side view of the adapter of FIG. 4.
Figure 4:
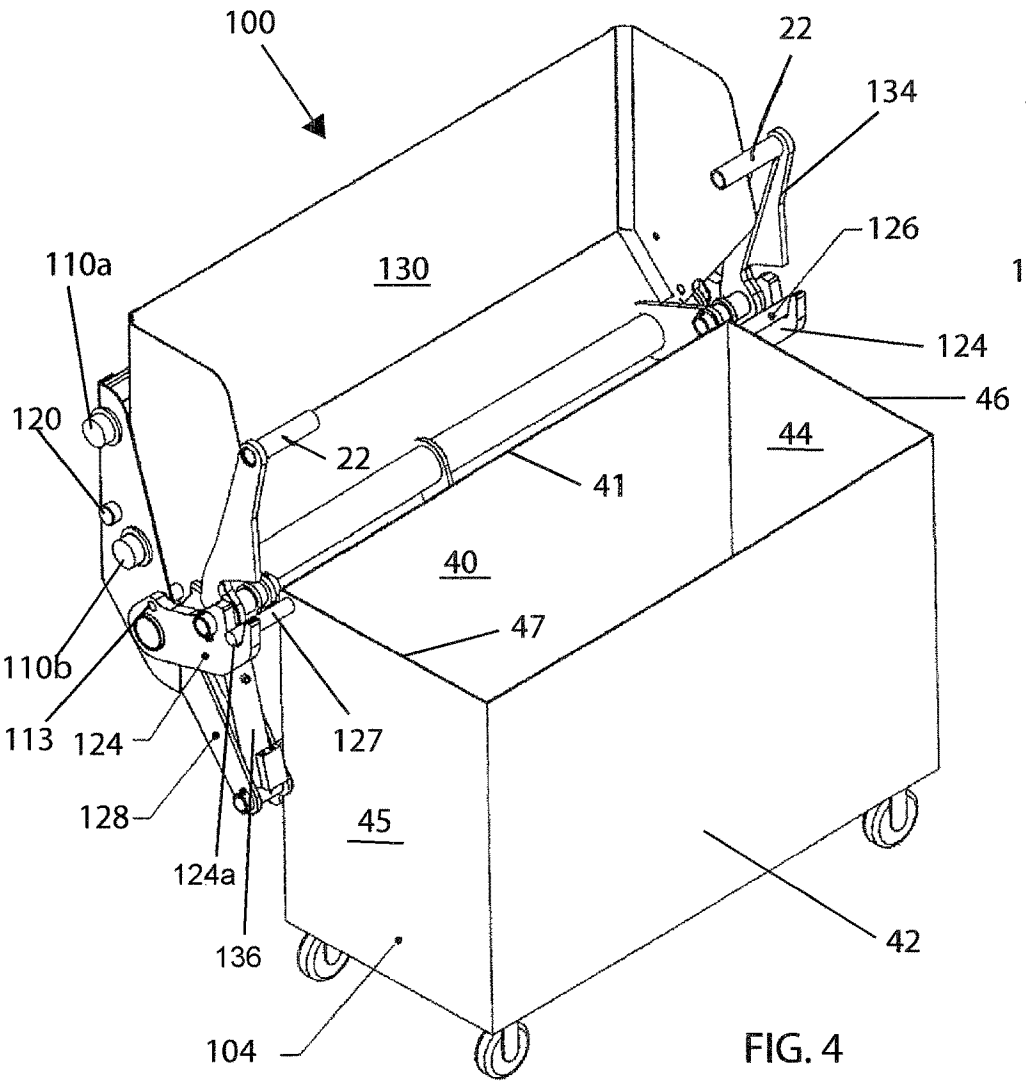
FIG. 4 is a perspective view of the adapter of the present invention showing the adapter mechanism open or unclamped on a container.

FIGS. 1-3 depict a side loading refuse collection vehicle 1, including an adapter 100 to enable a lift mechanism 102 to attach and lift a rear end load refuse container 104. As described below, container 104 may be attached to lifting mechanism 102 and commodity disposed therein can be emptied into a corresponding compaction chamber 106 of collection vehicle 1. Compaction blades within compaction chamber 106 compact the commodity and drive it into a storage compartment 108 of collection vehicle 1.

As can be understood from reference to FIGS. 4-7, a rear end loading container such as rear end loading container 104 includes front wall 40 and rear wall 42 joined by shorter end walls 44, 45. Rear end loading refuse container 104 also includes trunnions 126, 127 which extend laterally from opposing end walls 44, 45 of the container 104. Trunnions 126, 127 are located near top 41 of front wall 40 and are typically coaxial. Each trunnion 126, 127 is receivable within a trunnion pocket 124*a* of one trunnion pocket member 124 when the rear end loading refuse container 104 is brought adjacent adapter 100 with front wall 40 thereof facing adapter 100. With trunnions 126, 127 cradled within trunnion pockets 124*a*, lock arms 134 may be rotated into their lowered position in contact with top edges 46, 47 of end walls 44, 45 of container 104 to force container 104 against stabilizer 128. Each lock arm 134 may include a bar element 22 extending laterally therefrom, preferably perpendicularly, at or near the free end thereof, such that each bar element 22 extends toward the other. Lock arms 134 may be driven independently, or they may operate simultaneously.

Refuse collection vehicle 1 includes a conventional cab 2 and wheels 4 connected to and supported on a chassis or frame 6 which carries storage compartment 108 and compaction chamber 106. A tailgate 8 is pivotally attached to the top of storage compartment 108 by vertically displaceable hinges 10 at the rear of refuse collection vehicle 1. Tailgate lift cylinders 12 are pivotally attached to tailgate 8 and to storage compartment 108. To unload refuse collection vehicle 1, tailgate lift cylinders 12 are extended to vertically displace and pivot or swing tailgate 8 to an open position, and the commodity may be expelled out of storage compartment 108.

As shown in FIGS. 1-3, container 104 may be selectively attached to lift mechanism 102 by way of adapter 100. Attached container 104 is raised from a lowered position with container 104 on the ground to an inverted raised position above load opening 26 of compaction chamber 106 of collection vehicle 1 for unloading the commodity.

Lift mechanism 102 lifts adapter 100 along tracks 112 attached to a side wall 114 of compaction chamber 106 of collection vehicle 1. Lift mechanism 102 includes lift rods 111 attachable to adapter 100 at a receptacle 113. Receptacle 113 may be a hole in a trunnion pocket member 124 to receive a bolt for combining lift rods 111 to trunnion pocket member 124. Carriage track rollers 110*a*, 110*b* positioned on opposing sides of adapter 100 engage and follow spaced apart tracks 112 as adapter 100 is lifted between positions. Lift rods 111 are pivotally attached at their ends to corresponding lift arms 116. A compaction chamber cover 118 extends between corresponding lift arms 116 to cover compaction chamber 106. A lift cylinder (not shown) anchored to collection vehicle 1 engages each lift arm 116 to automatically raise and lower lift mechanism 102 between the lowered and raised positions. When lift arms 116 elevate, compaction chamber cover 118 rises from its rest position overlying the load opening 26 of compaction chamber 106.

In the illustrated embodiment, each lift cylinder is extended when lift mechanism 102 is in the lowered position. In the lowered position, compaction chamber cover 118 and attached lift arms 116 are substantially horizontal, with compaction chamber cover 118 overlying the load opening 26 of compaction chamber 106. As the cylinder retracts, lift arms 116 pivot upward and pull lift rods 111 which draw adapter 100 to the raised position.

More specifically, two pairs of carriage track rollers 110*a*, 110*b* are positioned on each side of adapter 100 and align with a pair of rails 112*a*, 112*b* that form each track 112. Carriage track rollers 110*a*, 110*b* are spaced apart such that carriage track roller 110*a* rides against rail 112*a* inside track 112. Carriage track roller 110*b* rides against rail 112*b* on the outside of track 112. At an upper curved portion 112*c* of track 112, carriage track rollers 110*a* move away from rail 112*a*. An idler roller 120 is positioned apart from carriage track rollers 110*a*, 100*b* to guide adapter 100 in its transition between a lower portion 112*d* and upper portion 112*c* of track 112. Upper portion 112*c* of each track 112 is angled away from compaction chamber 106 and curved at its upper end to guide container 104 in an arcuate path to an inverted unloading position.

In the lowered position, container 104 is positioned on the ground and alongside side wall 114 of vehicle 1. Adapter 100 combined with lift mechanism 102 lifts container 104 off the ground. Carriage track rollers 110*a*, 110*b* are positioned against respective rails 112*a*, 112*b* of tracks 112 and guide adapter 100 upward. At upper portions 112*c* of tracks 112 each carriage track roller 110*a* moves away from rail 112*a* of track 112 and each idler roller 120 moves against the inside of rails 112*b* of tracks 112 to prevent adapter 100 from moving backward and forward. Upper portion 112*c* of each track 112 guides adapter 100 outward in the arcuate path and tips container 104 to its upward inverted position, as shown in FIG. 3.

Figure 8:
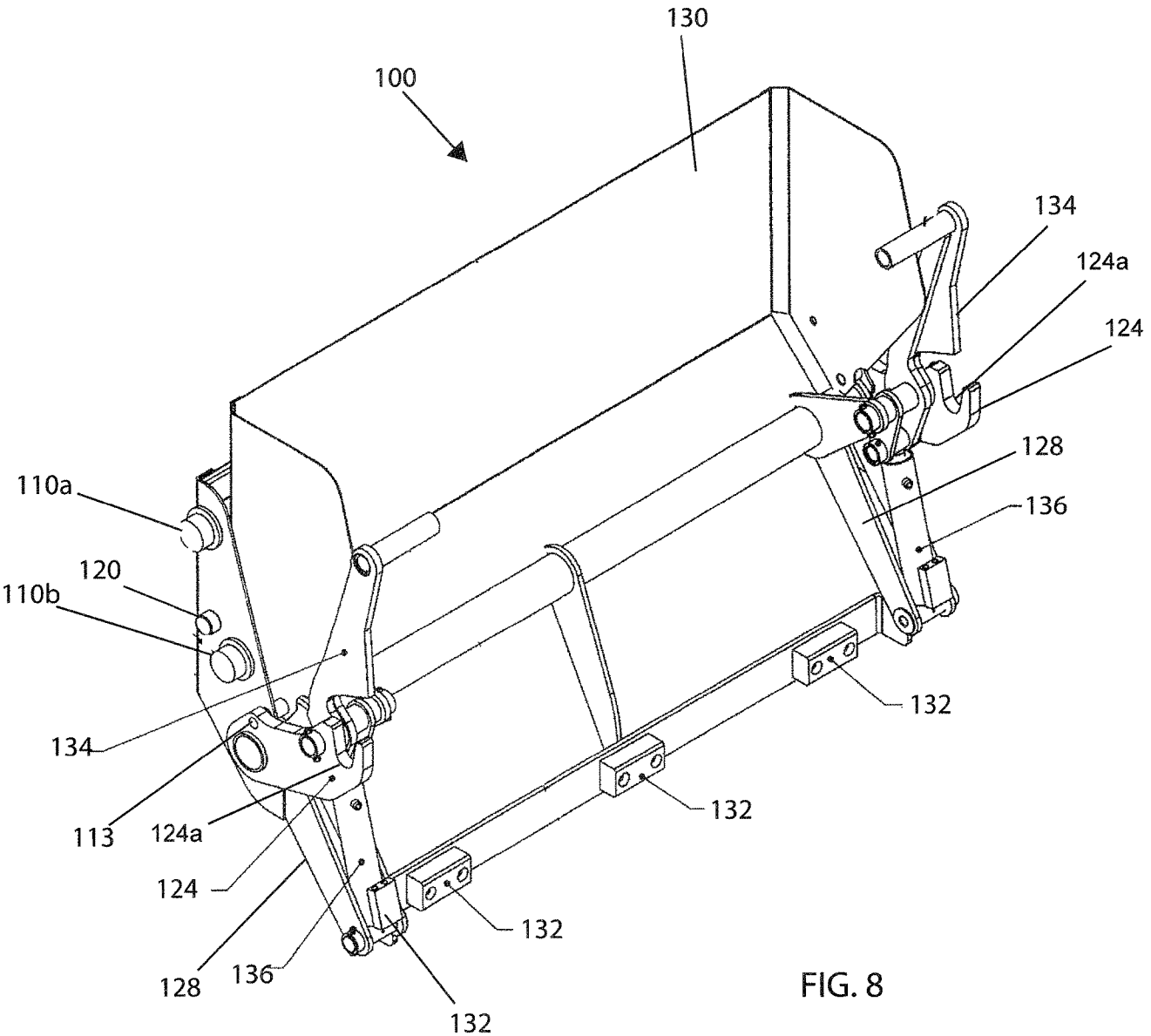
FIG. 8 is a perspective view of the adapter of the present invention.
Figure 10:
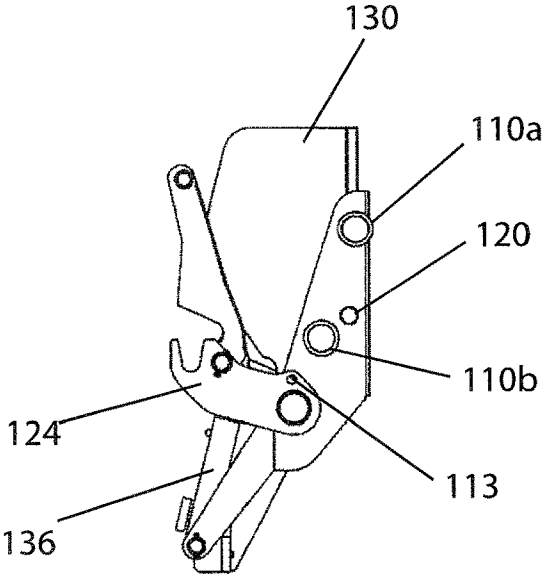
FIG. 10 is a side view of the adapter of FIG. 9.
Figure 9:
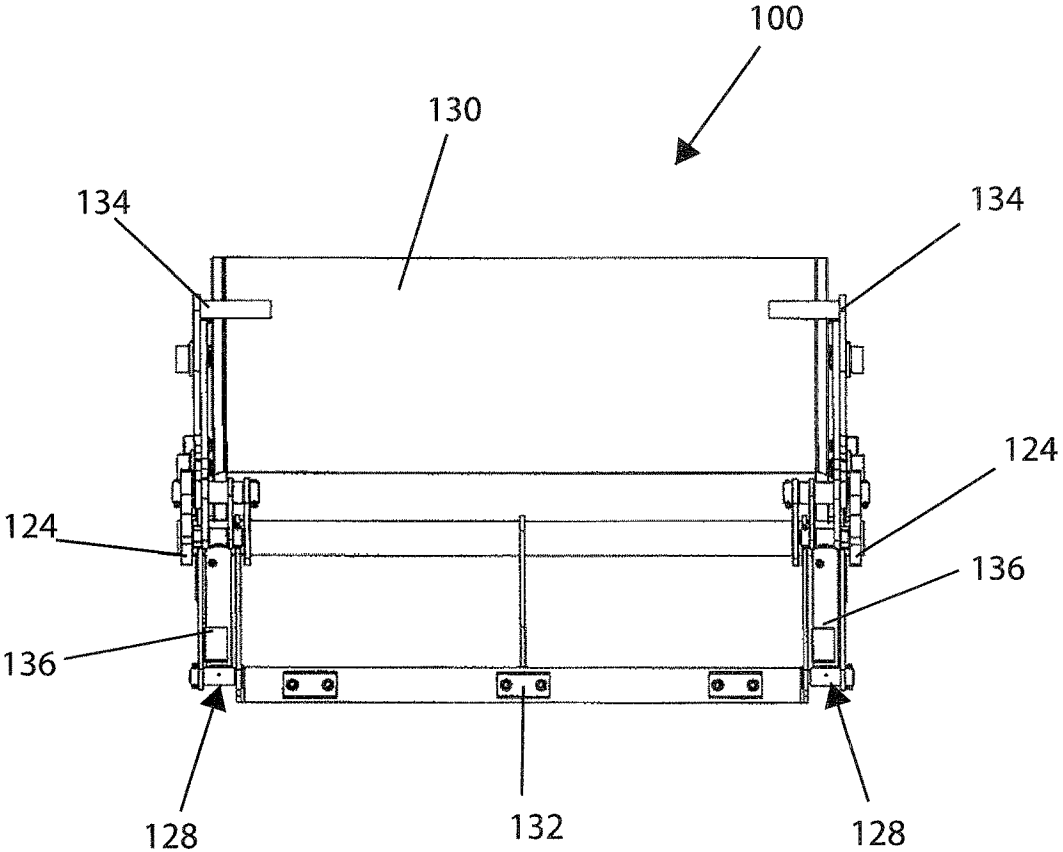
FIG. 9 is a front view of the adapter mechanism of FIG. 8.

Referring to FIGS. 8-10, the adapter 100 is shown separate from lift mechanism 102 and vehicle 1. When it is desirable to collect and empty a rear load container 104, adapter 100 is replaceably attached to lift mechanism 102. As described above, lift arms 111 are replaceably bolted to receptacles 113 on respective trunnion pocket members 124 of adapter 100. Carriage track rollers 110*a*, 110*b* are positioned within tracks 112. Side loaded refuse collection vehicle 1 is now ready for receiving rear loaded trunnion style containers.

Adapter 100 is more specifically described as follows. Trunnion pocket members 124 are positioned on opposing sides of adapter 100 to locate and securely cradle the trunnions 126, 127 on container 104 in curved pockets 124*a* of trunnion pocket members 124. A stabilizer 128 abuts front wall 44 of container 104 when it is placed in position to be secured to adapter 100 and includes rubber bumpers 132 to support and hold the front wall 44 of container 104 as it is lifted between the respective positions. A pair of lock arms 134 are powered by drivers 136 to rotate lock arms 134 down on the top of container 104 to securely clamp container 104 between lock arms 134 and stabilizer 128. Lock arms 134 rotate about an axis to the clamped position and extend from the axis to engage the top rim of container 104. At the end of each lock arm 134 is a bar member 22 that extends perpendicularly towards the inside of container 104 to ensure container 104 does not fall when lifted to the inverted position. A guide plate 130 is combined with the stabilizer 128 and extends between the pair of trunnion pocket members 124 and above the container 104 to act as a guide to prevent refuse from falling outside of the chamber 106 when the container 104 is in the inverted unloading position. Lift mechanism 102 can now lift a rear loaded trunnion style container 104 by its trunnions 126, 127 between the inverted unloading position and the initial ground position.

To gain more perspective of adapter 100, referring back to FIG. 1, adapter 100 is assembled on a side loader collection vehicle 1 with stabilizer 128 abutting container 104 and lock arms 134 powered down on the top of container 104 by a driver 136, which is a hydraulic cylinder 136 in the illustrative embodiment, thereby clamping container 104 between lock arms 134 and stabilizer 128 in the ground pick-up position. FIG. 3 shows the perspective of adapter 100 with clamped container 104 rotated to an inverted unloading position.

Figure 7:
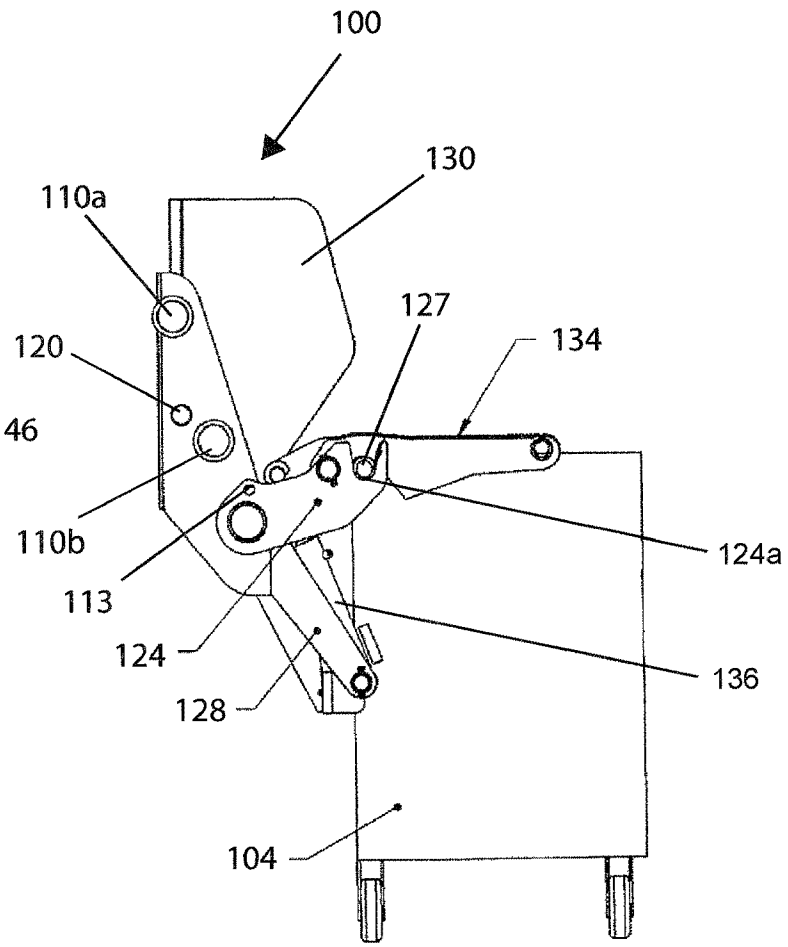
FIG. 7 is a side view of the adapter mechanism of FIG. 6.
Figure 6:
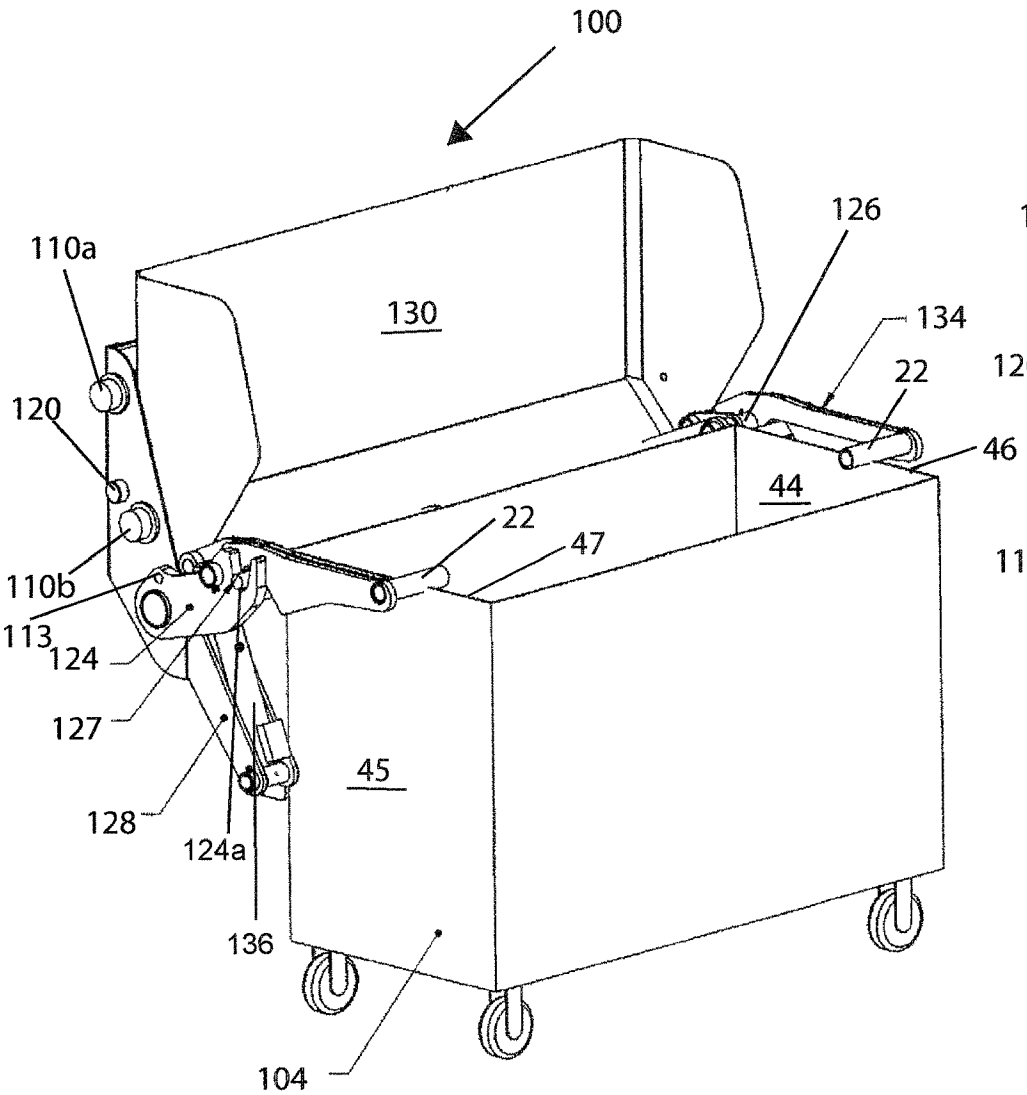
FIG. 6 is a perspective view of the adapter of the present invention showing the adapter closed or clamped on a container.

In further detail, referring back to FIGS. 4 and 5, container 104 is shown combined with adapter 100 and with lock arms 134 in the open position. Adapter 100 is positioned at an appropriate distance from the ground to enable container 104 to be rolled up alongside adapter 100. Container 104 is positioned with its trunnions 126, 127 slightly above trunnion pocket members 124 of adapter 100. Lock arms 134 clamp down on the top of container 104 and secure trunnions 126, 127 in pockets 124*a* of trunnion pocket members 124. Container 104 is thereby secured between lock arms 134 and stabilizer 128 of adapter 100, as shown in FIGS. 6 and 7 so that container 104 is prevented from rotating about an axis defined by trunnions 126, 127.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. A side loading mechanism for a commodity collection body, the commodity collection body having a chamber for receiving commodity from an external container, the external container having a trunnion extending from each of two opposing end walls of the container, the side loading mechanism comprising:

a lifting mechanism combined to the collection body and extending alongside the chamber for lifting the container to an inverted unloading position above the chamber for depositing commodity from the container into the chamber, a removable adapter removably attached to the lifting mechanism, the removable adapter comprising a pair of spaced apart trunnion receiving members, the removable adapter further comprising at least one lock arm moveable by a powered driver, the at least one lock arm selectively touchingly engaging a top rim of the external container to secure the external container to the adapter for lifting the external container to the inverted unloading position.

2. A side loading mechanism for a commodity collection body having a chamber with a top loading opening, the commodity collection body having a lifting mechanism adapted for lifting an external container along a side of the chamber, the side loading mechanism comprising:

a pair of spaced apart trunnion pocket members, the trunnion pocket members movable in a substantially vertical direction, the trunnion pocket members adapted to selectively receive respective trunnions extending from opposing ends of a rear loading commodity container, a pair of lock arms selectively rotatable about an axis, each arm touchingly engaging a top edge of an opposing end wall of the rear loading commodity container when the arms are moved to a lowered position, the lifting mechanism mounted to the trunnion pocket members, the lifting mechanism operable to elevate the rear loading commodity container to a position above the loading opening of the collection body;

a stabilizer replaceably positionable against a front of the container to hold the container in position and prevent the container from rotating about the trunnions when the container is lifted between the loading position and the inverted unloading position;

a driver combined with the stabilizer and having a rod combined with the pair of lock arms to move the pair of lock arms to the locked position with the container held firmly between the stabilizer and the pair of lock arms to secure the container as it is lifted between the loading position and the inverted unloading position.

3. The side loading mechanism of claim 2 further comprising a stabilizer element touchingly engaging a front wall of the rear loading commodity container when the lift mechanism has raised the rear loading commodity container from the loading position.

4. The side loading mechanism of claim 2 wherein each arm includes a bar element extending generally laterally therefrom, each bar element transverse to the arm from which the bar element extends, each bar element touchingly engaging the top edge of one of the opposing end walls of the rear loading refuse container when the arms are rotated to the lowered position.

5. The side loading mechanism of claim 2, further comprising a guide plate extending above the pocket members and disposed therebetween, the guide plate generally aligned with a front wall of the rear loading commodity container when the trunnions are received in the trunnion pocket members.

6. The side loading mechanism of claim of claim 2, further comprising a guide plate combined with the stabilizer and extending between the pair of trunnion pockets to prevent refuse from falling outside of the chamber when the container is in the inverted unloading position.

7. The side loading mechanism of claim of claim 6, wherein the stabilizer comprises a pair of stabilizer legs spaced apart and aligned with opposing ends of the container.

* * * * *